US008007220B2

(12) United States Patent
Vandyke et al.

(10) Patent No.: US 8,007,220 B2
(45) Date of Patent: Aug. 30, 2011

(54) WHEELCHAIR LIFTING BAY

(76) Inventors: David Vandyke, West Sussex (GB); Philip Wickens, East Sussex (GB); Stephen Campbell, West Sussex (GB)

( * ) Notice: Subject to any disclaimer, the term of this patent is extended or adjusted under 35 U.S.C. 154(b) by 711 days.

(21) Appl. No.: 11/791,210

(22) PCT Filed: Mar. 13, 2006

(86) PCT No.: PCT/GB2006/000877

§ 371 (c)(1),
(2), (4) Date: May 22, 2007

(87) PCT Pub. No.: WO2006/114563

PCT Pub. Date: Nov. 2, 2006

(65) Prior Publication Data

US 2008/0014069 A1 Jan. 17, 2008

(30) Foreign Application Priority Data

Apr. 28, 2005 (GB) ..... 0508705.1

(51) Int. Cl.
*B63C 3/00* (2006.01)

(52) U.S. Cl. ..... 414/678; 414/778

(58) Field of Classification Search ..... 414/778, 414/779, 781, 921, 678, 754, 743, 546
See application file for complete search history.

(56) References Cited

U.S. PATENT DOCUMENTS

| | | | | |
|---|---|---|---|---|
| 3,458,056 | A * | 7/1969 | Harkins et al. | 414/778 |
| 3,638,813 | A | 2/1972 | Strong | 414/742 |
| 4,192,549 | A | 3/1980 | Petersen | 297/464 |
| 4,725,188 | A | 2/1988 | Zimmermann et al. | 414/678 |
| 4,726,730 | A * | 2/1988 | McConnell | 414/678 |
| 5,421,693 | A * | 6/1995 | Petersen | 414/678 |
| 5,472,307 | A | 12/1995 | Kadlec | 414/678 |
| 5,890,869 | A | 4/1999 | LeMaster et al. | 414/678 |
| 6,478,529 | B1 | 11/2002 | Willey | 414/678 |
| 6,866,288 | B2 * | 3/2005 | Martin | 280/647 |

FOREIGN PATENT DOCUMENTS

| | | |
|---|---|---|
| EP | 1 205 172 | 5/2002 |
| WO | 91/13603 | 9/1991 |

* cited by examiner

*Primary Examiner* — Saúl J Rodriguez
*Assistant Examiner* — Glenn Myers
(74) *Attorney, Agent, or Firm* — Levy & Grandinetti

(57) ABSTRACT

A wheelchair lifting bay comprising base means, a lifting platform, lifting means and pivot means, in which the lifting platform is connected to the base means by the pivot means, in which the lifting platform comprises a bottom wall and a back wall, in which the pivot means is disposed rearward of said back wall and is spaced apart from it, in which the lifting means is mounted between the base means and the lifting platform forward of the pivot means, and in which the lifting means rotates the lifting platform about the pivot means in use such that the back wall follows a circumferential path about the pivot means.

16 Claims, 1 Drawing Sheet

WHEELCHAIR LIFTING BAY

Figure 1:
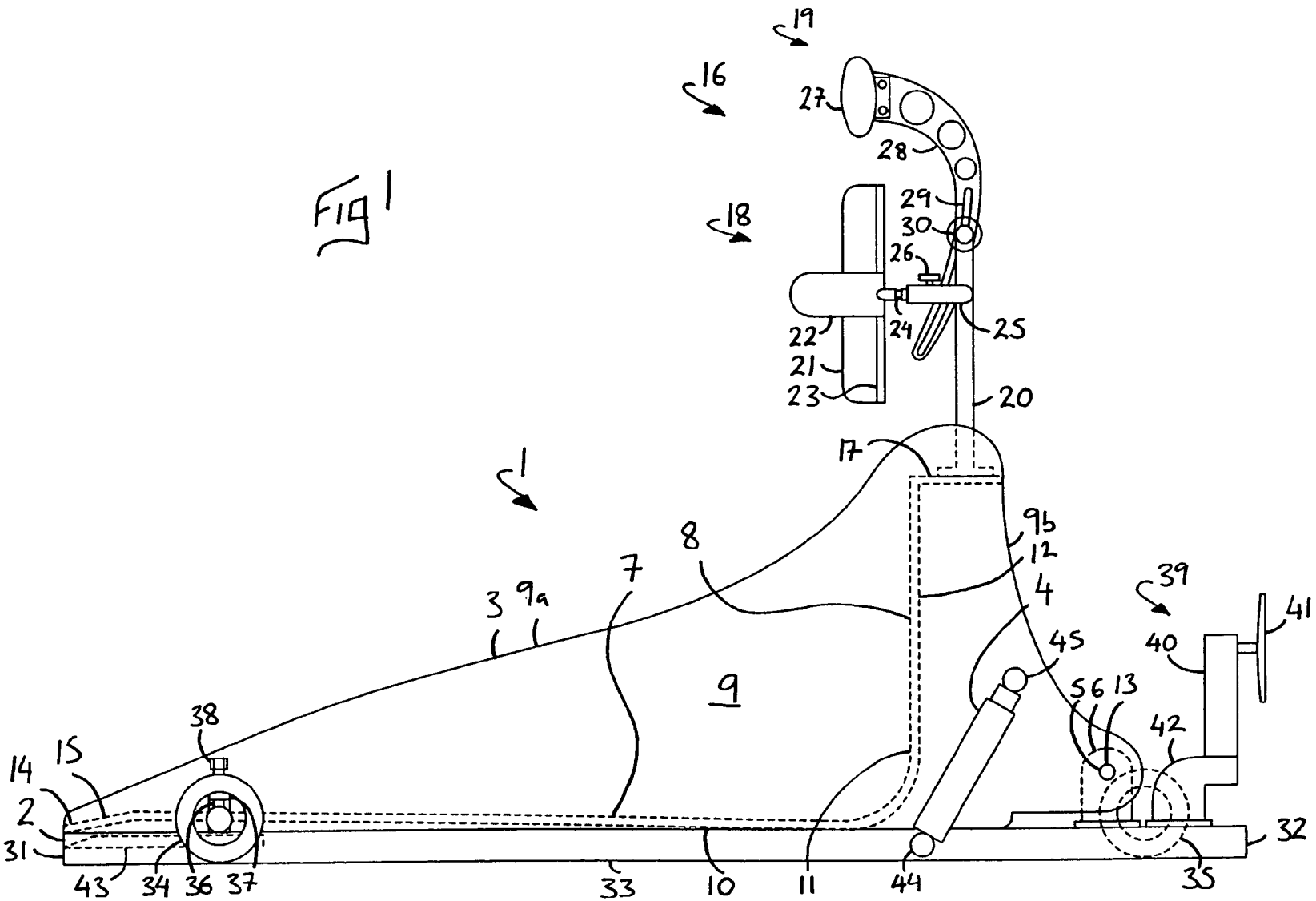

This application claims priority to and is the U.S. National Phase of PCT Application Number PCT/GB2006/000877, filed on 13 Mar. 2006, which claims priority to Great Britain Application Number 0508705.1, filed 28 Apr. 2005.

This invention relates to a wheelchair lifting bay, for use particularly, but not exclusively, to raise and orientate a wheelchair user to a suitable position to receive dental treatment.

In order to receive the best treatment, a dental patient's head needs to be facing upwards, and positioned at a suitable height for a seated dentist to readily access it.

This is commonly achieved by means of the known dental chair, which comprises a high backed seat which can be reclined to a flat position, and which can be raised and lowered as required. There are many known types of such dental chair, but they all operate in essentially the same way.

However, when a wheelchair bound patient needs to be seen, they need to be lifted from their wheelchair and placed on the dental chair. Likewise, at the end of the treatment they need to be lifted back into their wheelchair. This can be a very awkward exercise, and it has been found that in some instances the providers of treatment cannot perform it due to the lack of insurance provision to cover it.

The same problems can occur with other medical or cosmetic treatments of the head or upper body which require the recipient to lie in a reclined position on a treatment chair.

Therefore, a number of different wheelchair lifting bays have been proposed, which each raise and tilt back a wheelchair so the user's head is situated and orientated in a suitable manner for treatment to be provided. However all known examples of such wheelchair lifting bays suffer from a number of drawbacks.

Firstly, each version comprises separate lifting and tilting means to raise and tilt back the wheelchair, and as a result they are complex and expensive.

Secondly, all known examples can only be used with regular non-mechanically propelled wheelchairs. Such wheelchairs have large rear wheels propelled by the user, and have a space under the seat between the rear wheels. Most known lifting bays take advantage of this feature and position various components so they are between the rear wheels in use, for the sake of compactness. However, mechanically propelled wheelchairs often have small rear wheels and a battery or motor between the rear wheels low to the ground. As a result they cannot sit on the known lifting bays because some part or other of the apparatus is in the way. In addition, some known wheelchair lifting bays provide openings on the lifting bay to receive the wheels of a regular wheelchair. These are too large for the wheels of mechanically propelled wheelchairs which would fall through the openings and damage the chair.

The present invention is intended to overcome some of the above problems.

Therefore, according to the present invention, a wheelchair lifting bay comprises base means, a lifting platform, lifting means and pivot means, in which the lifting platform is connected to the base means by the pivot means, in which the lifting platform comprises a bottom wall and a back wall, in which the pivot means is disposed rearward of said back wall and is spaced apart from it, in which the lifting means is mounted between the base means and the lifting platform forward of the pivot means, and in which the lifting means rotates the lifting platform about the pivot means in use such that the back wall follows a circumferential path about the pivot means.

In use a wheelchair is placed on the lifting platform with its rear wheels up against the back wall. Thus, the wheelchair is spaced apart from the pivot means, and when the lifting platform rotates about the pivot means the wheelchair follows a circumferential path about the pivot means. Therefore, the wheelchair is not only lifted upwards by the lifting means, but it is also tilted back at the same time. This arrangement therefore removes the need for any separate tilting means.

The above invention can be implemented in many ways, and in one version the base means can be a floor. In such an arrangement the unit would be fixed in position, for example in a dental surgery. However, as demand for the invention would be limited in any one given location, in a preferred construction the wheelchair lifting bay can be portable. It can be a stand-alone unit, and the base means can be a chassis.

Preferably the lifting platform can support a backrest and headrest apparatus. The backrest and headrest apparatus can be disposed in such a position that when a wheelchair is placed on the lifting platform, the backrest and headrest apparatus supports a user of the wheelchair's back and head. The apparatus can be adapted to be adjustable to suit different sizes of user.

In one construction the chassis can have a front end adjacent a front of the lifting platform and a rear end adjacent the pivot means, and the chassis can be provided with a retractable stabilizer assembly at its rear end. The assembly can comprise a stabilizer arm provided with foot means, and retraction means, and the assembly can be adapted to prevent the wheelchair lifting bay from overturning when the lifting platform carries a load and is rotated about the pivot means in use.

The retraction means can comprises a 90 degrees pivot mechanism adapted to move the stabilizer arm from a first retracted position in which it is arranged substantially vertically, and a second in use position in which it is arranged substantially horizontally. The foot means can comprise a height adjustable foot platform adapted to be lowered and raised in use to contact a ground upon which the wheelchair lifting bay is sitting in use.

In a preferred arrangement the lifting platform can further comprise two side walls, which can each comprise a first portion which extends from a side edge of the bottom wall to a side edge of the back wall, and a second portion which extends beyond a rear of the back wall. With this arrangement the second portion can be provided with a pivot aperture which is connected to the pivot means.

The bottom wall can be angled downwards from its front to the back wall when the lifting platform is at a point of no lift. This feature urges a wheelchair onto the lifting platform and prevents it rolling off unintentionally.

In order to further facilitate the portability of the unit, the chassis can be a wheeled-chassis. The chassis itself can be generally square or rectangular and can have four corners, and there can be four wheels, one situated generally at each corner. The wheels can be retractable and the front pair can be fixed wheels, while the rear pair can be castor wheels.

Each wheel can be provided with a retraction mechanism comprising a threaded bolt in a threaded housing. The wheel can be mounted to a lower end of the threaded bolt and the threaded housing can be mounted to the chassis. Therefore, to raise the wheels and rest the unit on the chassis, the threaded bolt is rotated in one direction, and to lower the wheels and raise the chassis off the ground the threaded bolt is rotated in the opposite direction.

A retractable ramp can be provided at the front of the unit, which allows a wheelchair to be wheeled from the ground onto the lifting platform.

Preferably the lifting means can comprise one or more hydraulic rams. In one construction a first hydraulic ram can be mounted between a side of the chassis and the second portion of one side wall, and a second hydraulic ram can be mounted between an opposite side of the chassis and the second portion of the opposite side wall. The first and the second hydraulic rams can be pivotally mounted to the chassis, and they can be mounted to the side walls between the back wall and the pivot apertures provided on the side walls.

The hydraulic rams can be adapted to extend until the bottom wall reaches and angle of 50 degrees in relation to the chassis. The hydraulic rams can be connected to a motor powered hydraulics system in one arrangement, or in an alternative version they can be connected to a manually operable hydraulics system.

The invention can be performed in various ways but one embodiment will now be described by way of example and with reference to the accompanying drawing in which FIG. 1 is a side view of a wheelchair lifting bay according to the present invention.

As shown in FIG. 1 a wheelchair lifting bay 1 comprises base means, in the form of chassis 2, a lifting platform 3, lifting means, in the form of two hydraulic rams, (only one of which 4 is visible), and pivot means, in the form of pivot pin 5 and pivot mountings, (only one of which 6 is visible). The lifting platform 3 is connected to the base means (2) by the pivot means (5, 6), and the lifting platform 3 comprises a bottom wall 7 and a back wall 8. The pivot means (5, 6) is disposed rearward of said back wall 8 and is spaced apart from it, and the lifting means (4) is mounted between the base means (2) and the lifting platform 3 forward of the pivot means (5, 6). In use the lifting means (4) rotates the lifting platform 3 about the pivot means (5, 6) such that the back wall 8 follows a circumferential path about the pivot means (5, 6). (In FIGS. 1 and 2 some features or parts of features are shown in hashed lines because they are obscured behind other features.)

As is clear from FIG. 1, the wheelchair lifting bay is a stand-alone unit, and generally comprises chassis 2, and the lifting platform 3 mounted on it.

The lifting platform 3 is generally shaped as a wheelchair bay and comprises bottom wall 7, back wall 8 and two side walls, only one of which 9 is visible. The side wall 9 is ergonomically shaped and comprises a generally triangular shaped first portion 9*a* which extends from a side edge 10 of the bottom wall 7 to a side edge 11 of the back wall 8, and a generally triangular second portion 9*b* which extends beyond a rear 12 of the back wall 8. Pivot aperture 13 is provided in second portion 9*b*. The opposite side wall (not visible) is identical in construction to side wall 9 and extends from the opposites edges of the bottom wall 7 and back wall 8.

Thus, the first portions (9*a*) of the side walls (9) serve to enclose the bottom wall 7 and back wall 8 thereby to define a bay to receive a wheelchair in use. The second portions (9*b*) extend rearward in order to provide for the pivot apertures (13). Side wall 9 is connected to the pivot mount 6 by the pivot pin 5, and the opposite side wall (not visible) is connected to an opposite pivot mount (not visible) by the pivot pin 5, which extends between the pivot mounts (6).

The bottom wall 7 is angled downwards from its front 14 to the back wall 8 when the lifting platform 3 is at a point of no lift, as in FIG. 1. This feature urges a wheelchair onto the lifting platform 3 and prevents it rolling off unintentionally. A short ramp section 15 brings the bottom wall 7 back level with the top of the chassis 2 to provide ready access.

The lifting platform 3 supports a backrest and headrest apparatus 16. It is mounted on a surface 17 which extends rearward from the top of the back wall 8. The apparatus 16 comprises an adjustable backrest 18 and an adjustable headrest 19, which are mounted on two frame arms, only one of which 20 is visible.

The back rest 18 comprises a central cushion 21 which has two wing sections which curve outwards slightly, only the rear side of one of which 22 is visible. The cushion 21 is mounted on a back plate 23, which is mounted on two hinges, only one of which 24 is visible, for tilting it back and forth as desired. The hinges (24) are mounted on two adjustable length support arms, only one of which 25 is visible, which are mounted on the frame arms 20. A lateral adjustment mechanism comprising a grub screw, only one of which 26 is visible, is provided on both support arms (25) to allow the cushion to be lockably moved back and forwards as desired.

The head rest 19 comprises a cushion 27 mounted on a curved support member 28. The support member 28 is provided with an adjustment slot 29 which is mounted on a spindle 30, which is itself mounted between the tops of the two frame arms 20. The height and orientation of the support member 28 can be adjusted by sliding the slot 29 over the spindle 30 and rotating the support member 28 about the spindle 30. The support member 28 can be locked in any position with a clamp mechanism provided on the spindle 30 (not visible).

The chassis 2 is a rectangular frame constructed from metal beams. It has a front 31, a rear 32 and sides, only one of which 33 is visible. The pivot mounts (6) are mounted on each side (33) adjacent the rear 32.

The chassis 2 is provided with retractable wheels, only one of which 34 is shown in full. The four wheels are positioned generally at the corners of the chassis frame in the manner of any four wheeled vehicle.

The two wheels at the front of the chassis (34) are fixed direction wheels and face in the direction of the chassis 2. The two rear wheels (the outline of one of which 35 is shown in hashed lines for reference) are castor wheels which provide for the chassis 2 to be steered.

Each wheel is mounted on a threaded bolt which is housed in a threaded housing mounted on the chassis 2, by means of which the wheels can be raised and lowered in use.

Referring to wheel 34, it is mounted on threaded bolt 36, which is housed in threaded housing 37. The threaded bolt 36 has a bolt head 38 which can be rotated by a spanner thereby to raise and lower the wheel 34 in use. An identical arrangement is provided for each of the four wheels, except that the threaded housings for the rear wheels are mounted on outriggers (not shown) which are mounted on the chassis 2, so as to allow the rear wheels (35) to rotate through 360 degrees without fouling on the chassis 2.

The chassis 2 is further provided with a retractable stabilizer assembly 39 at its rear end 32. The assembly 39 comprises a stabilizer arm 40 provided with foot means 41, and retraction means, in the form of hinged L-shaped support arm 42. The support arm 42 is mounted on a hinge (not visible) so it can move from a retracted position as shown in FIG. 1, to an in-use position 90 degrees clockwise from that shown, in which the arm 40 is parallel to the ground. The foot means 41 is height adjustable so it can be lowered and raised in use to contact the ground as required.

A retractable ramp (the outline of which 43 is shown in hashed lines) is provided at the front 31 of the chassis 2. The ramp 43 can be pulled out to provide ready access onto the bottom wall 7 of the lifting platform in use, which would otherwise require a wheelchair to negotiate the step formed by the front 31 of the chassis 2.

A hydraulic ram is provided on each side of the wheelchair lifting bay 1, but only one 4 is visible. The rams are mounted between the chassis 2 and the lifting platform 3, and serve to raise and lower the lifting platform 3 in use. Referring to ram 4, it has a lower mounting ring 44 which is pivotally mounted to the side 33 of the chassis 2. It has an upper mounting ring 45 which is mounted to the portion 9*b* of the side wall 9, between the back wall 8 and the pivot means (5, 6). The opposite ram (not visible) is mounted in the same way on the opposite side of the wheelchair lifting bay 1.

The rams (4) are operated by a manually operable hydraulics mechanism of a known kind. It is not shown in FIG. 1, and is not further described here because it is commonly known equipment. However, the mechanism is located on the chassis 2, behind the back wall 8.

The rams (4) are arranged to extend until the bottom wall 7 reaches and angle of 50 degrees in relation to the chassis 2.

In use the wheelchair lifting bay 1 is first arranged in position. It can be moved into position by virtue of its wheels (34, 35). Once in the right place the wheels (34, 35) are retracted by rotation of the threaded bolts (36), until the chassis 2 is resting on the ground.

The ramp 43 is pulled out, and a wheelchair (not shown) is reversed over the ramp 43 and onto the bottom wall 7 of the lifting platform 3, until the rear wheels of the wheelchair touch the back wall 8. (It will be appreciated that any kind of wheelchair can be placed on the lifting platform 3 because no part of the mechanism of the wheelchair lifting bay 1 extends into the lifting platform 3 which might prevent some wheelchairs from being placed there.) The corner where the bottom wall 7 and the back wall 8 meet is rounded so the wheels of the wheelchair can sit neatly in place. The angled nature of the bottom wall 7 urges the wheelchair into the loaded position and prevents it rolling off unintentionally. The first portions (9*a*) of the side walls (9) encloses the wheelchair and prevents it falling from either side of the lifting platform 7.

The backrest and headrest apparatus 16 is then adjusted by means of the mechanisms described above until the backrest cushion 21 contacts the upper back of the wheelchair user, and the headrest cushion 27 contacts the back of their head.

The support arm 42 of the stabilizer assembly 39 is rotated through 90 degrees so the stabilizer arm 40 is parallel to the ground, and the foot means 41 is adjusted until it contacts the ground.

The wheelchair lifting bay 1 is then ready for operation. The hydraulics mechanism (not shown) is operated until the hydraulic rams (4) have raised the lifting platform 3 far enough for a treatment provider to gain ready access to the head of the wheelchair user. The lifting platform 3 can be lifted to any position up to 50 degrees to the chassis 2. The stabilizer assembly 39 prevents the wheelchair lifting bay 1 from overturning when the lifting platform 3 is raised.

It will be appreciated from the above that the position of the pivot means (5, 6) in relation to the back wall 8, and therefore the wheelchair, means that when the lifting platform 3 rotates about the pivot means (5, 6) the wheelchair follows a circumferential path about the pivot point. The wheelchair is therefore lifted up and tilted back.

Once the treatment has been finished the lifting platform 3 is lowered by the rams (4) until it is back in the position shown in FIG. 1. The wheelchair can then be wheeled off the bottom wall 7 and down the ramp 43.

If another patient is then seen the above described process is repeated with the backrest and headrest apparatus 16 adjusted accordingly.

If the wheelchair lifting bay 1 is to be moved to another location the lifting platform 3 is arranged in the lowered position shown in FIG. 1, and the stabilizer arm 40 is returned by the support arm 42 to the vertical position shown in FIG. 1. The wheels (34, 35) are then lowered to raise the chassis 2 off the ground. The bolt heads (38) are rotated to force the threaded bolts (36) through the threaded housings (37) and force the wheels (34, 35) downwards. The wheels (34, 35) can be lowered until the chassis is 25 mm off the ground. Once this is achieved the chassis 2 can be pushed on the wheels, and steered by means of the rear castor wheels (35). Once in position in the new location the wheels (34, 35) are retracted in a reverse of the above described procedure until the chassis 2 is resting on the ground.

The above described embodiments can be altered without departing from the scope of Claim 1. For example, in one alternative embodiment (not shown) the hydraulics mechanism which operates the rams (4) is a motor powered system.

In another alternative embodiment (not shown) the wheelchair lifting bay can be a non-portable fixed device in which the lifting platform is mounted to a pivot means fixed to the floor. In such an arrangement the "base means" of the invention comprises the floor.

Thus, a wheelchair lifting bay is provided which readily and effectively raises and orientates a wheelchair user to a suitable position to receive dental treatment, or any other medical or cosmetic treatment to the head or upper body area.

The invention claimed is:

1. A wheelchair lifting bay comprising base means, a lifting platform, lifting means and pivot means, in which the lifting platform is connected to the base means by the pivot means, in which the base means is a chassis, in which the lifting platform comprises a bottom wall and a back wall, in which the pivot means is disposed rearward of said back wall and is spaced apart from it, in which the lifting means is mounted between the base means and the lifting platform forward of the pivot means, in which the lifting means rotates the lifting platform about the pivot means in use such that the back wall follows a circumferential path about the pivot means, in which the lifting platform further comprises two side walls, each of which comprises a first portion which extends from a side edge of the bottom wall to a side edge of the back wall, and a second portion which extends beyond a rear of the back wall, in which the second portions are each provided with a pivot aperture which is connected to the pivot means, in which the lifting means comprises a first hydraulic ram mounted between a side of the chassis and the second portion of one side wall, and a second hydraulic ram mounted between an opposite side of the chassis and the second portion of the opposite side wall, in which the first and the second hydraulic rams are pivotally mounted to the chassis, and in which the first and second hydraulic rams are mounted to the side walls between the back wall and the pivot apertures when the bottom wall is in a horizontal position.

2. A wheelchair lifting bay as claimed in claim 1 in which the wheelchair lifting bay is a stand-alone unit, and in which the base means is a chassis.

3. A wheelchair lifting bay as claimed in claim 2 in which the lifting platform supports a backrest and headrest apparatus, in which the backrest and headrest apparatus is disposed in such a position that when an occupied wheelchair with which the wheelchair lifting bay is used is placed on the lifting platform with its rear wheels against the back wall, the backrest and headrest apparatus supports a user of the wheelchair's back and head.

4. A wheelchair lifting bay as claimed in claim 3 in which the backrest and headrest apparatus is adapted to be adjustable.

5. A wheelchair lifting bay as claimed in claim 4 in which the chassis has a front end adjacent a front of the lifting platform and a rear end adjacent the pivot means, and in which the chassis is provided with a retractable stabilizer assembly at its rear end comprising a stabilizer arm provided with foot means, and retraction means, in which the stabilizer assembly is adapted to prevent the wheelchair lifting bay from overturning when the lifting platform carries a load and is rotated about the pivot means in use.

6. A wheelchair lifting bay as claimed in claim 5 in which the retraction means comprises a 90 degrees pivot mechanism adapted to move the stabilizer arm from a first retracted position in which the stabilizer arm is arranged substantially vertically, and a second in use position in which the stabilizer arm is arranged substantially horizontally.

7. A wheelchair lifting bay as claimed in claim 6 in which the foot means comprises a height adjustable foot platform adapted to be lowered and raised in use to contact a ground upon which the wheelchair lifting bay sits in use.

8. A wheelchair lifting bay as claimed in claim 7 in which the bottom wall is angled downwards from its front to the back wall when the lifting platform is at a point of no lift.

9. A wheelchair lifting bay as claimed in claim 2 in which the chassis is a wheeled-chassis.

10. A wheelchair lifting bay as claimed in claim 9 in which the chassis has four corners and is provided with four retractable wheels, each on generally situated at a corner of the chassis.

11. A wheelchair lifting bay as claimed in claim 10 in which the two wheels adjacent the front of the chassis are fixed direction wheels and in which the two wheels adjacent the rear of the chassis are castor wheels.

12. A wheelchair lifting bay as claimed in claim 11 in which each wheel is provided with a retraction mechanism comprising a threaded bolt in a threaded housing, in which the wheel is mounted to a lower end of the threaded bolt and the threaded housing is mounted to the chassis.

13. A wheelchair lifting bay as claimed in claim 5 in which the chassis is provided with a retractable ramp at its front end adapted to allow a wheelchair with which the wheelchair lifting bay is used to be wheeled from a ground upon which the wheelchair lifting bay sits in use onto the lifting platform.

14. A wheelchair lifting bay as claimed in claim 13 in which the first and the second hydraulic rams are adapted to extend until the bottom wall reaches and angle of 50 degrees in relation to the chassis.

15. A wheelchair lifting bay as claimed in claim 14 in which the first and the second hydraulic rams are connected to a motor powered hydraulics system.

16. A wheelchair lifting bay as claimed in claim 14 in which the first and the second hydraulic rams are connected to a manually operable hydraulics system.

* * * * *